United States Patent [19]

Terai

[11] Patent Number: 4,636,113

[45] Date of Patent: Jan. 13, 1987

[54] LANDING ADJUSTMENT SYSTEM FOR OFFSHORE STRUCTURES

[76] Inventor: Kiyohide Terai, 2-23-1, Higashi Nakano, Nakano-ku, Tokyo, Japan

[21] Appl. No.: 654,785

[22] Filed: Sep. 26, 1984

[30] Foreign Application Priority Data

Sep. 27, 1983 [JP] Japan ..... 58-178953

[51] Int. Cl.[4] ..... E02B 17/00

[52] U.S. Cl. ..... 405/203; 405/195; 405/204

[58] Field of Search ..... 405/205, 206, 207, 208, 405/195, 203; 114/264, 265

[56] References Cited

U.S. PATENT DOCUMENTS

| | | | |
|---|---|---|---|
| 3,224,401 | 12/1965 | Kobus | 405/205 X |
| 3,241,324 | 3/1966 | Storm et al. | 405/205 X |
| 3,306,052 | 2/1967 | Kawasaki | 405/205 |
| 3,486,343 | 12/1969 | Gibson et al. | 405/208 |
| 3,653,219 | 4/1972 | Mott | 405/205 |
| 3,729,940 | 5/1973 | Koehler | 405/205 |
| 3,982,492 | 9/1976 | Steddum | 405/205 X |
| 4,091,760 | 5/1978 | Lloyd | 114/265 X |
| 4,241,685 | 12/1980 | Mougin | 405/205 X |

FOREIGN PATENT DOCUMENTS

| | | |
|---|---|---|
| 1234974 | 6/1971 | United Kingdom . |
| 1592735 | 7/1981 | United Kingdom . |

*Primary Examiner*—Dennis L. Taylor
*Attorney, Agent, or Firm*—Yount & Tarolli

[57] ABSTRACT

A landing adjustment system for offshore marine structures is disclosed herein. The system comprises a plurality of columns extending downwardly from the underside of the offshore marine structure and having the lower ends provided within the columns, the buoyancy by the tanks resting on the sea bed and buoyancy tanks being individually adjustable.

5 Claims, 4 Drawing Figures

LANDING ADJUSTMENT SYSTEM FOR OFFSHORE STRUCTURES

BACKGROUND OF THE INVENTION

This invention relates to a landing adjustment system suitable for the installation of offshore marine structures such as offshore cities and the platforms of offshore oil fields and of offshore towers, for example, at the sea bed.

Of late, there has been a constant increase in population throughout the world. This increase in population presents grave problems in that the price of land for housing inevitably rises in a very small country such as Japan where the land area is extremely restricted in relation to the high density of population and in that the high population density tends to lead to a deterioration in the living environment which results in uncomfortable living conditions. In order to solve these problems, attempts have been made to effectively utilize offshore areas by constructing or installing offshore structures such as offshore cities and the platforms of offshore oil fields and towers at the sea bed.

Hithertofore, when offshore local districts or the platforms of offshore oil fields or towers are constructed or installed in offshore areas, the following three methods have been generally used: the first method is to construct an artificial island by reclamation, the second method is to float an offshore local district formed of a buoyant structure such as a pontoon on the sea and anchor the buoyant structure to the sea bed by suitable anchor means and the third method is to construct an offshore city on reinforced concrete or steel studs planted on the sea bed. However, since the artificial island involves reclamation, the laying out of the reclaimed island requires a colossal amount of investment and the depth of water places a limitation on the number of potential sites available for such artificial islands. The anchoring means for a buoyant offshore structure such as a pontoon requires frequent troublesome adjustment and the construction of the offshore city on reinforced concrete or steel studs encounters difficulties in terms of expensive foundation work. Thus, it has been found that each of the above mentioned conventional methods have their own inherent disadvantages.

SUMMARY OF THE INVENTION

The present invention is to provide a novel and improved landing adjustment system for offshore marine structures which can effectively eliminate the disadvantages of these conventional offshore structures.

In order to attain the object of the present invention, according to the present invention, the offshore marine structure and the landing adjustment system are partially or completed assembled before installation and the subassembly or assembly is carried to the offshore site for installation and rested the sea bed without being anchored to the sea bed.

According to the present invention, a landing adjustment system has been provided for an offshore marine structure which essentially comprises a plurality of columns extending downwardly from the underside of said offshore marine structure and having the lower ends resting on the sea bed, a plurality of buoyancy tanks one of which is provided within each of said columns and having a tank chamber formed within the column, the buoyancy provided by said buoyancy tanks being individually adjustable, monitor means for continuously monitoring the combined gravity on the offshore marine structure and column assembly and the combined buoyancy by said buoyancy tanks to establish a predetermined relationship between the gravity and buoyancy so as to maintain the offshore marine structure in a stabilized horizontal state, and means for compensating for variation in the buoyancy provided by said buoyancy tanks.

The above and other objects and attendant advantages of the present invention will be more readily apparent to those skilled in the art from a reading of the following detailed description in conjunction with the accompanying drawings which show one preferred embodiment of the invention for illustration purposes only, but not for limiting the scope of the same in any way.

DETAILED DESCRIPTION OF THE PREFERRED EMBODIMENTS

Figure 1:
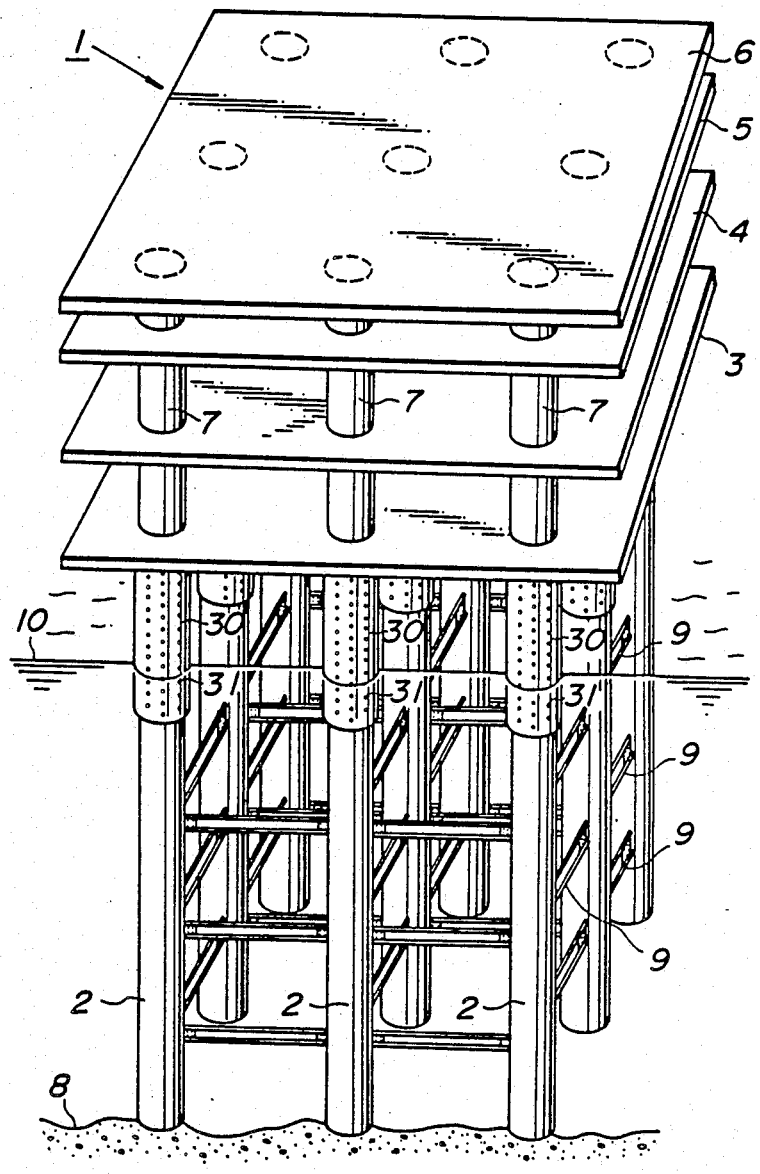
FIG. 1 is a fragmentary perspective view of an offshore structure which is utilized as a city and to which the landing adjustment system of the invention is applied.

Referring to the accompanying drawings particularly, FIG. 1, in which the landing adjustment system according to the present invention is shown as being applied to an offshore multi-storey structure which constitutes a city, for example, the landing adjustment system generally comprises a plurality of upright column 2, 2 . . . which extend downwardly in spaced relationship from the underside of the offshore marine structure which is generally shown by reference numeral 1. The offshore marine structure comprises a foundation (not shown) having a regular square configuration as seen in plane with each side measuring about 5 km and a plurality of floors provided on the foundation. The floors comprise a first of lowermost floor 3, a second floor 4, a third floor 5 and a fourth or topmost floor 6 arranged in that order in vertically spaced relationship between immediately adjacent structure components. In the illustrated embodiment, although not shown, the first or lowermost floor 3 has a supply circulation system, a waste recycle system and energy and water supply systems installed thereon. The second floor 4 is adapted to be utilized as an industrial lot by building factories and plants thereon. The third floor 5 has installed thereon transport and road networks and control systems therefor. The fourth or topmost floor 6 is adapted to be utilized as a lot where facilities for living, education and culture, medical treatment, recreation and/or airplane departure and arrival are built. The several floors are supported horizontally by the second and third floors 4, 5 and are embedded at the upper and lower ends thereof in the topmost and lowermost floors 6, 3, respectively. The several floors can be communicated with each other by installing staircases between the floors or elevators (not shown) on the main pillars 7, for example.

The several floors are not limited to the applications referred to above, but may be employed for other purposes by installing other facilities thereon which are suitably selected depending upon the environment where the offshore marine structure is positioned.

Figure 2:
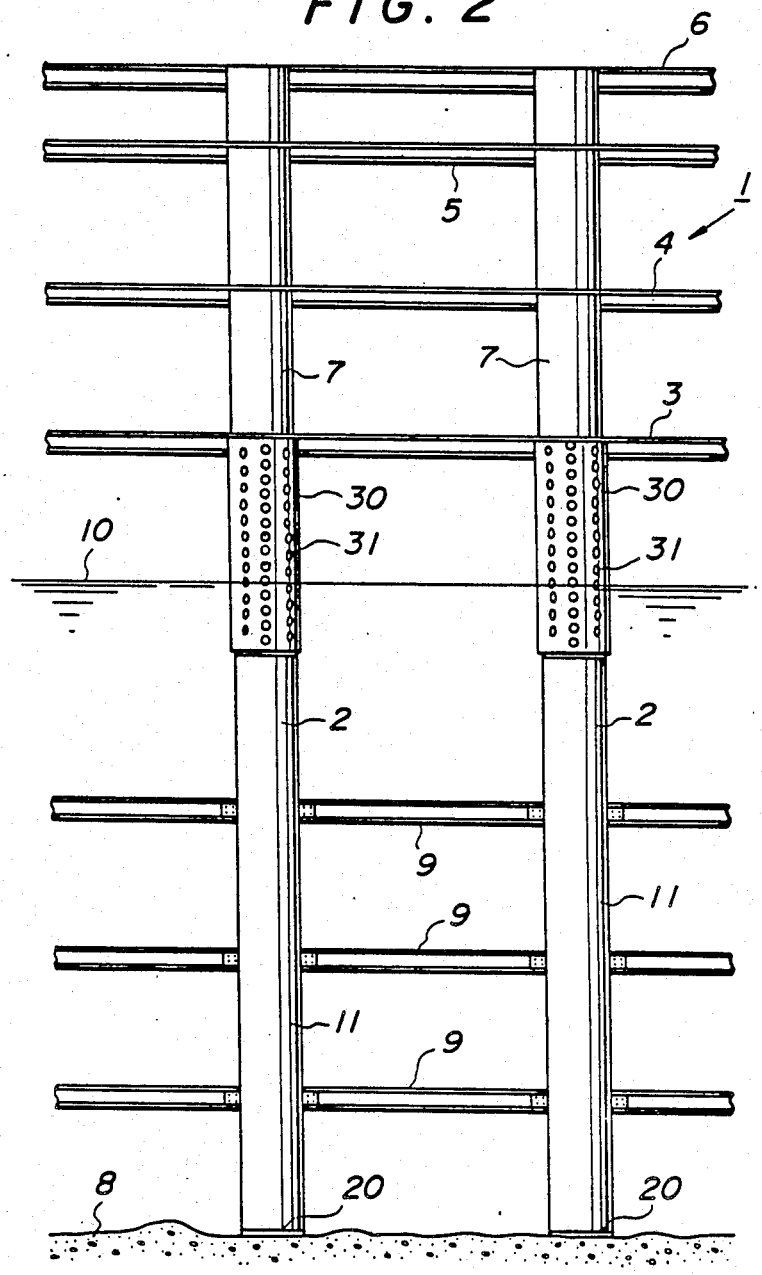
FIG. 2 is a side elevational view on an enlarged scale of a portion of FIG. 1.

In the illustrated embodiment, each of the columns 2 is formed of a cylindrical steel bar with the lower end thereof resting on the sea bed 8 without being anchored thereto. As more clearly shown in FIG. 2, the columns 2 are connected together by means of a connecting means with a space of 50 m, for example, left between adjacent columns 2. In the illustrated embodiment, the connecting means consists of a plurality of I-section steel members 9 connected pivotally together by means of pin-hinge joints (not shown), for example. In the illustrated embodiment, the columns 2 have an outer diameter of about 10 m and the distance between the surface 10 and the sea bed 8 is assumed to be about 100 m.

Figure 3:
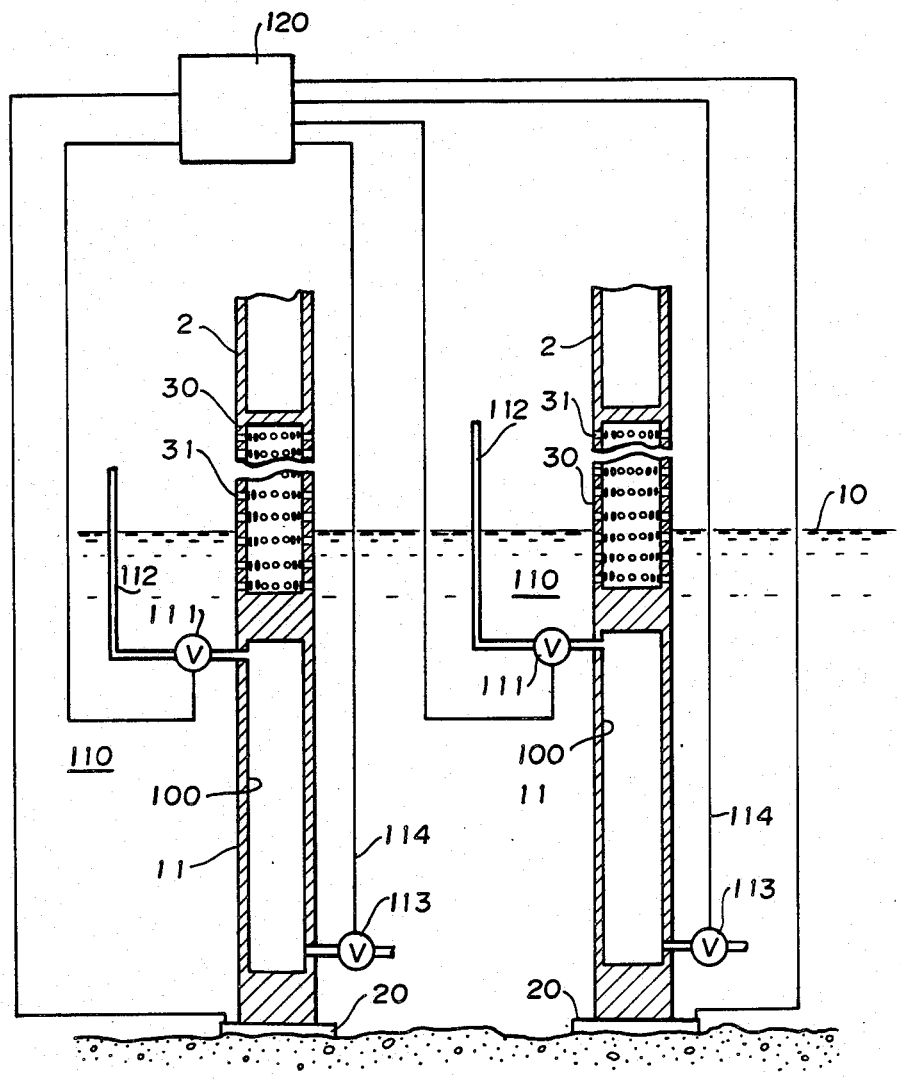
FIG. 3 is a fragmentary schematic sectional view of a buoyancy tank used in the landing adjustment system according to the present invention.

Each of the cylindrical columns 2 has a buoyancy tank 11 provided therein. As shown in FIG. 3, the buoyancy tank 11 comprises a tank chamber 100 formed within the associated column 2. The tank chamber of the buoyancy tank 11 is in communication with fluid supply and drainage means 110 through which fluid such as sea water or the like is introduced into and discharged out of the tank chamber. The fluid supply and drainage means 110 includes a supply valve 111 and a discharge valve 113 connected to the tank chamber 100, respectively. A conduit 112 is connected to the supply valve 111 and a conduit 114 is connected to the discharge valve 113. Thus, the buoyancy provided by the buoyancy tanks can be individually adjusted by introducing and discharging the sea water into and out of the buoyancy tanks, by means of a computer as will be described hereinafter.

In such a case, it is to be noted that the combined buoyancy provided by the buoyancy tanks is set to be slightly less than the gravity bearing on the offshore structure and stud assembly whereby the lower ends of the columns 2 rest lightly on the sea bed 8. The adjustment of the buoyancy provided by the buoyancy tanks 11 in the manner mentioned hereinabove assists in maintaining the offshore marine structure 1 in its desired horizontal state.

By the provision of the buoyancy tank arrangement referred to hereinabove, the offshore marine structure 1 can be held in position by merely adjusting the buoyancy to be provided by the buoyancy tanks without the employment of the conventional anchoring means or foundation work on the sea bed.

According to the present invention, a balance adjusting device is provided to continuously balance the position of the offshore marine structure and column assembly to thereby constantly maintain the assembly in its proper position. The balance adjusting device comprises pressure sensors 20 provided on the lower end faces of the columns 2 and a computer 120 operatively and commonly connected to the pressure sensors. The fluid supply and drainage means 110 of each of the tanks 11 is connected to the computer (see FIG. 3). The pressure sensor 20 is adapted to electrically detect any difference between the buoyancy and gravity acting on the associated column and then provides an electrical signal which is passed to the computer. The computer is provided, for example, in the control compartment of the offshore structure. The computer is adapted to monitor the buoyancy provided by the tanks and to continuously compare the signals from the several pressure sensors 20 with a reference signal stored in the computer and when it is found that the signals from the sensors deviate from the reference signal, the above-mentioned fluid supply or drainage means are operated to supply or discharge fluid into or out of the buoyancy tanks 11 so as to adjust the buoyancy provided by the buoyancy tanks such as to maintain the offshore marine structure in its desired horizontal state.

Since it is anticipated that the gravity and buoyancy acting on the offshore structure and column assembly continuously vary as the level of the surface 10 of the sea fluctuates by the action of waves and the ebb and flow of tide, the present invention provides means for compensating for variation in the buoyancy so as to maintain the offshore structure in its stabilized or horizontal position regardless of the action of waves and the ebb and flow of tide. As shown in FIG. 3, such means includes a hollow portion 30 formed in each of the columns 2 in the upper end portion of the associated column with a portion of the hollow portion projecting above the surface 10 of the sea (see FIG. 2). The hollow portion 30 is provided in the peripheral wall thereof with a number of small through holes 31. When the surface of the sea 10 tends to momentarily rise from the position shown in FIG. 2 under the action of waves, although the buoyancy acting on the columns 2 increases momentarily in consequence of the rise in the level of the surface 10, the sea water providing increment of buoyancy flows into the hollow portion 30 through the upper holes 31 and instantly flows out of the hollow portion 30 through the lower holes 31 whereby the increase in the buoyancy acting on the columns is controlled. Thus, the buoyancy variation compensating means of the present invention compensates for variation in the buoyancy caused by the fluctuation in the level of the surface 10 under the action of waves to thereby maintain the gravity bearing on the offshore structure and column assembly and the buoyancy provided by the buoyancy tanks in the above-mentioned relationship.

Figure 4:
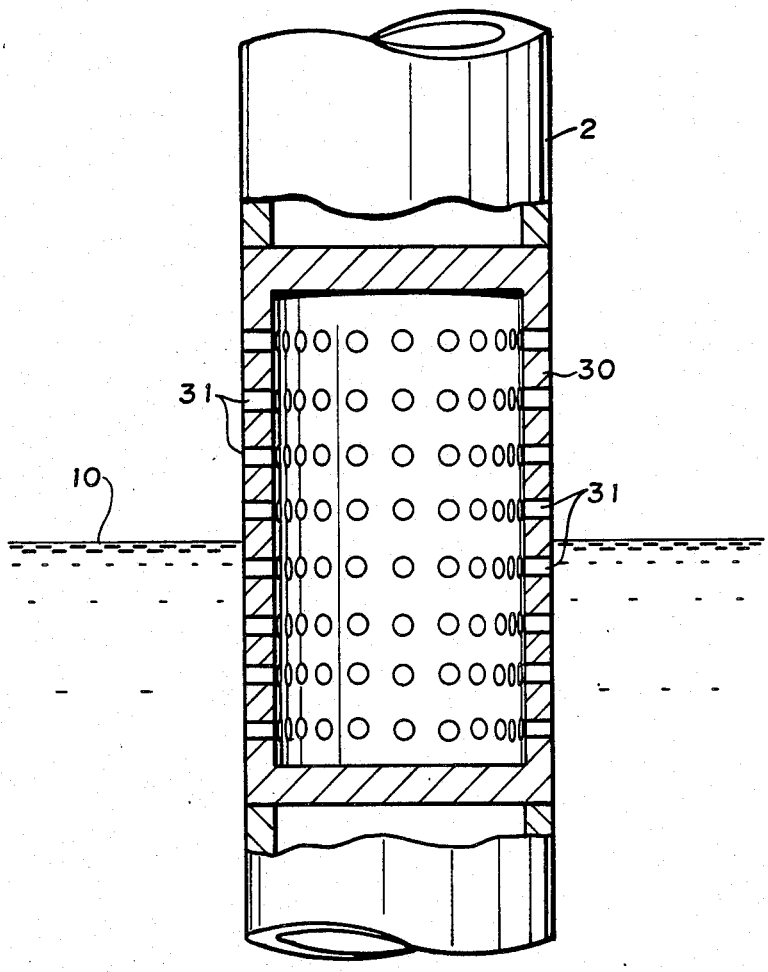
FIG. 4 is a fragmentary schematic sectional view of a balance adjusting device.

Alternatively, the compensating means may be a hollow member connected to the column (see FIG. 4). The hollow member has a plurality of holes in the peripheral wall thereof.

In the establishment of an offshore city by the use of the landing adjustment system according to the present invention, as an example, a plurality of partial assemblies comprising combined columns are formed in a dock and then these assemblies are towed by a tugboat to a predetermined location or the site of installation where the offshore marine structure 1 is to be established. When the assemblies have been towed to this location, the buoyancy provided by the buoyancy tanks is adjusted to a degree that the lower ends of the columns rest on the sea beds. The assemblies are then combined together and the above-mentioned floors are constructed on the combined assemblies to form the offshore marine structure 1. Communication between the thus established offshore marine structure and the land is provided by means of aircraft and/or hydrofoils.

The offshore structure landing adjustment system of the present invention provides the following practical effects:

1. In the establishment of the offshore city by the offshore structure, since it is only necessary to rest the offshore structure on the sea bed, any anchoring means and foundation work on the sea bed can be eliminated to thereby substantially reduce the cost.

2. Since the buoyant columns are in the form of a substantially hollow cylindrical steel bar and the buoyancy provided by each of the tanks can be adjusted independently of the others, as compared with the conventional columns formed of solid rigid material of heavy weight, the columns 2 are simpler in production and substantially lighter in weight which results in a reduction in costs.

3. Since each of the buoyant columns operates independently of the others, the columns can separately compensate for displacement of the earth crust due to events such as earthquake and other natural disasters to thereby stabilize the offshore structure assembly whereby a safe offshore city is established.

4. Since the buoyancy provided by the buoyancy tanks within the hollow columns is continuously monitored by the computer, the buoyancy provided by the buoyancy tanks and the gravity bearing on the offshore structure and column assembly can be maintained in a predetermined relationship so as to precisely hold the offshore structure in its horizontal state.

5. The provision of the buoyancy variation compensating means eliminates the necessity of continuous fine adjustment of the buoyancy which may vary as the level of the sea water fluctuates periodically.

6. Since the inherent dead weight of the offshore structure proper can be set to be less than the buoyancy to be provided by the buoyancy tanks by adjusting the buoyancy, any offshore structure of large size can be installed without difficulty.

7. Since the offshore structure can be installed by module construction using the separate columns, when sufficient space is not available to meet increasing needs for space, additional space may be obtained by removing one or more of the columns.

Although the invention has been described in connection with the embodiment which is applied to the establishment of an offshore city, the invention is not limited to this embodiment and can be equally well applied to the construction of the platforms of offshore oil field platforms and of offshore towers. Also the invention is applicable to the construction of buoyant structures in lakes and rivers.

While the invention has been particularly shown and described with reference to the preferred embodiment thereof, it will be understood by those skilled in the art that various changes in form and details may be made therein without departing from the spirit and scope of the invention.

What is claimed is:

1. An offshore structure adapted to rest on the bed of a body of water, said structure comprising a platform for receiving a load, a plurality of columns extending downwardly from said platform, said columns having lower end portions adpated to rest on the bed of the body of water, a plurality of tanks connected with said columns, detector means for detecting the amount of force applied by said columns against the bed of the body of water, and control means connected with said detector means for adjusting the bouyancy of said tanks as a function of the amount of force detected by said detector means.

2. An offshore sturcture as set forth in claim 1 wherein said detector means includes a plurality of detectors each of which is connected with one of said columns and provides an output which varies as a function of the force transmitted from the one column to the bed of the body of water, said control means including means responsive to the output of said plurality of detectors to maintain the force transmitted from each of said columns to the bed of the body of water at a desired magnitude.

3. An offshore structure as set forth in claim 1 wherein said tanks are disposed within said columns.

4. An offshore structure as set forth in claim 1 wherein each of said columns includes bouyancy compensation means for compensating for variations in the level of the body of water relative to the columns, said bouyancy compensation means includes a hollow column portion having openings extending between inner and outer side surfaces of the columns to enable water to flow into and out of the hollow column portion with variations in the level of the body of water.

5. An offshore structure as set forth in claim 1 wherein said control means includes means for adjusting the bouyancy of said tanks to maintain an upper side surface of said platform in a horizontal orientation.

* * * * *